United States Patent [19]

Jones

[11] Patent Number: 4,817,714

[45] Date of Patent: Apr. 4, 1989

[54] DECREASING TOTAL FLUID FLOW IN A FRACTURED FORMATION

[75] Inventor: Timothy A. Jones, Carrollton, Tex.

[73] Assignee: Mobil Oil Corporation, New York, N.Y.

[21] Appl. No.: 85,667

[22] Filed: Aug. 14, 1987

[51] Int. Cl.[4] ..... E21B 43/22; E21B 43/26; E21B 43/263; E21B 47/04

[52] U.S. Cl. ..... 166/252; 166/254; 166/268; 166/271; 166/272; 166/299; 166/300; 166/308

[58] Field of Search ..... 166/252, 254, 271, 272, 166/274, 281, 299, 300, 308, 268

[56] References Cited

U.S. PATENT DOCUMENTS

| | | | |
|---|---|---|---|
| 3,346,048 | 10/1967 | Strange et al. | 166/252 |
| 3,501,201 | 3/1970 | Closmann et al. | 166/271 X |
| 3,537,529 | 11/1970 | Timmerman | 166/281 X |
| 3,613,789 | 10/1971 | Son, Jr. | 166/281 |
| 3,630,279 | 12/1971 | Fast et al. | 166/281 |
| 3,677,343 | 7/1972 | Showalter | 166/252 |
| 3,682,246 | 8/1972 | Closmann | 166/271 |
| 3,863,709 | 2/1975 | Fitch | 165/1 |
| 3,918,521 | 11/1975 | Snavely, Jr. et al. | 166/272 |
| 4,018,293 | 4/1977 | Keller | 175/4.5 |
| 4,039,030 | 8/1977 | Godfrey et al. | 166/299 |
| 4,067,389 | 1/1978 | Savins | 166/246 |
| 4,305,463 | 12/1981 | Zakiewicz | 166/281 X |
| 4,415,035 | 11/1983 | Medlin et al. | 166/308 |
| 4,479,894 | 10/1984 | Chen et al. | 252/8.554 |
| 4,489,783 | 12/1984 | Shu | 166/272 |
| 4,513,821 | 4/1985 | Shu | 166/272 |
| 4,524,434 | 6/1985 | Silverman | 166/254 X |
| 4,565,249 | 1/1986 | Pebdani et al. | 166/303 |
| 4,718,490 | 1/1988 | Uhri | 166/271 X |

*Primary Examiner*—George A. Suchfield
*Attorney, Agent, or Firm*—Alexander J. McKillop; Charles J. Speciale; Charles A. Malone

[57] ABSTRACT

A process for decreasing total fluid flow through a large natural or induced fracture where smaller multiple fractures are created. These multiple fractures each have a smaller aperture than said natural or induced fracture. The combined fluid flow through said multiple fractures is sufficiently less than the total fluid flow through said large fracture, thereby decreasing fluid bypass and improving sweep efficiency.

17 Claims, 1 Drawing Sheet

DECREASING TOTAL FLUID FLOW IN A FRACTURED FORMATION

FIELD OF THE INVENTION

This invention is directed to a method for decreasing total fluid flow from a formation into a wellbore where fracture apertures are reduced.

BACKGROUND OF THE INVENTION

Several articles and publications have attempted to deal with the engineering of a fractured reservoir. Among these is a book authored by E. S. Romm entitled "Fluid Flow in Fractured Rocks", and published by Nedra Publishing House, Moscow, Russia in 1966. The author cites laboratory research done in Russia, Europe, and the United States through 1966 on fluid flow through fractures. This book deals mainly with the theoretical formulation of fluid flow equations using Romm's own work and that of others. All topics concerning single-phase, two-phase flow, gas flow, and water imbibition are discussed. The book also presents some laboratory work done on fluid flow in very tight fractures (0.25 to 2.9 microns) and some two-phase systems.

In a text book published in 1982 by Elsevier Scientific Publishing Co., New York, N.Y., entitled "Fundamentals of Fractured Reservoir Engineering", T. D. Van Golf-Racht tries to integrate existing published material into a complete book on fractured reservoir engineering. His aim is to present new analytical tools to engineers and geologists for examining fractured reservoirs, since conventional reservoir evaluation techniques do not apply to fractured reservoirs.

A book written in 1980 by L. H. Reiss entitled "The Reservoir Engineering Aspects of Fractured Formations" is a primer on fractured reservoir engineering. This book was published by Gulf Publishing Co., Houston, Tex. It covers the basic problems for fractured reservoir evalution, but only presents published solutions without substantial theoretical or experimental backup. It is a good first book to read for fractured reservoir engineering.

Another book, written in 1980 by R. Aguilera, entitled "Naturally Fractured Reservoirs", is an organized collection of papers without any conclusions. This book was published by the Petroleum Publishing Co. located in Tulsa, Okla. It presents the data and correlations without expanding on the ideas. This book does have a good summary of pertinent papers.

A new book written by R. A. Nelson entitled "Geologic Analysis of Naturally Fractured Reservoirs", published in 1985, was written to supplement the other books listed above. Nelson wrote this book to present a rock data approach to fractured reservoir evaulation. This book was published by the Gulf Publishing Co., Houston, Tex.

None of these publications have resolved the problem of fingering caused by large fractures in oil fields during secondary recovery operations. This problem occurs because large fractures can become conduits from injection to production wells which cause an inefficient sweep to occur. Therefore, what is needed is a method to decrease fluid bypass so better sweep efficiency can be obtained.

SUMMARY OF THE INVENTION

Fluid bypass is decreased in reservoirs containing at least one substantially large natural or induced fracture. In the practice of this invention, at least one substantially large fracture is located which fracture causes "fingering" in said reservoir. Thereafter, a fracturing method is used to create smaller multiple fractures. These smaller fractures are created by applying a force sufficient to create said multiple fractures whihc have smaller apertures that produce a total lower flow rate than said large fracture. The resultant lower flow rate occurs because of the cubed root dependence of the flow rate to fracture aperture.

Creation of the smaller multiple fractures substantially closes said large fracture and decreases the overall fluid flow which previously emitted from said large fracture. Reducing the fluid flow decreases fluid bypass thereby providing for a more efficient sweep efficiency. In the case of a hydrocarbonaceous fluid containing reservoir, this more efficient sweep of the reservoir affords for the increased recovery of hydrocarbonaceous fluids.

It is therefore an object of this invention to increase the recovery of hydrocarbonaceous fluids from a formation by creating smaller multiple fractures in lieu of a large fracture to reduce steam flow bypass during a steamflood.

It is another object of this invention to increase the recovery of hydrocarbonaceous fluids from a formation by creating smaller multiple fractures in lieu of a large fracture to reduce carbon dioxide bypass during a carbon dioxide recovery process.

It is a yet another object of this invention to increase the recovery of hydrocarbonaceous fluids from a formation by creating smaller multiple fractures in lieu of a large fracture to reduce water bypass during a waterflood recovery process.

DESCRIPTON OF THE PREFERRED EMBODIMENT

In the practice of this invention, one substantially large fracture is located which causes "fingering" of fluids from a reservoir or formation. This "fingering" generally results when a large natural or induced fracture dominates fluid flow. This problem may exist when attempting to remove fluids from a formation, particularly oil, water, gas or steam. It is of concern in oil fields when a secondary recovery operation is utilized because a large "fingering" fracture may become a conduit from an injection well to a production well thereby decreasing sweep efficiency. The location of this large "fingering" fracture can be determined by those skilled in the art such as geologists.

In one embodiment of this invention, a controlled pulse or high energy fracturing method is used to create the smaller multiple fractures. The drawings are illustrative of said controlled pulse or high energy fracturing. Hydraulic fracturing can also be used to create the smaller multiple fractures.

Figure 1:
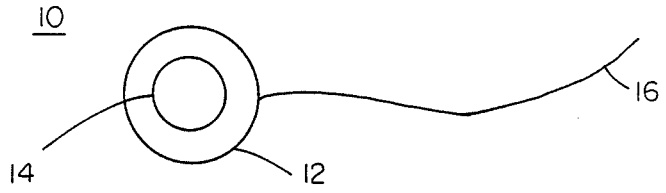
FIG. 1 is a plane view of a formation depicting one large fracture prior to ignition of a propellant.

FIG. 1. is a plane view which depicts the large "fingering" fracture 16 interconnected with wellbore 12 in formation 10. Inside wellbore 12 is propellant device 14. After fracture 16 has been located, in one embodiment, a propellant device 14 contained in a cannister is suspended from the ground level in wellbore 12. This device is located near fracture 16. The opening or aperture of fracture 16 can be determined, preferably before the propellant device 14 is suspended in wellbore 12. After the aperture or opening of fracture 16 is determined, the size and number of fractures to be created are determined in order to obtain the desired reduction in flow. The number and size of the desired fractures are determined by using Boussinesq's cubic law formula for steady-state isothermal, laminar flow between two parallel plates. This equation is $$Q = \frac{Wpg(b)^3\Delta h}{L12\mu}$$

where

Q=flow rate ($L^3/T$)
W=width of fracture face (L)
p=density ($M/L^3$)
g=acceleration of gravity ($L/T^2$)
b=fracture aperture (L)
Δh=hydraulic head of water (L)
L=length of fracture (L)

The total fluid flow is governed by the third root of the fracture aperture. If, for example, fracture 16 has an aperture of 0.1 inches, reducing it to three smaller fractures of 0.034 inches, each will reduce the total fluid flow by 88%. This is explained further when it is ascertained that $Wpg(b)^3\Delta h/L12\mu$ is a constant or "C". Therefore, $Q=Cb^3$ where b, the fracture aperture, becomes the variable. The total fluid flow in 0.1 inch "fingering" fracture 16 is determined to be 0.0010, i.e., $Q=C(0.1)^3=C(0.0010)$. When three smaller fractures are created in lieu of "fingering" fracture 16, each smaller fracture would have an aperture of 0.034. Thus, the total fluid flow through all three apertures would be C(0.000118) i.e., $Q=3[C(0.034)^3]=C(0.000118)$. Reduction of flow is equal to $0.001 - 0.000118/0.0010 \times 100 = 88\%$.

In order to create the required number of multiple fractures with the desired apertures, it is preferred to use a propellant as disclosed by Godfrey et al. in U.S. Pat. No. 4,039,030 which issued on Aug. 2, 1977. This patent is hereby incorporated by reference. To accomplish this said cannister containing a propellant is suspended into a wellbore. This cannister is placed downhole next to the "fingering" fracture 16.

The propellant in the cannister can belong to the modified nitrocellulose or the modified and unmodified nitroamine propellant class. Suitable solid propellants capable of being utilized include a double-based propellant known as N-5. It contains nitroglycerine and nitrocellulose. Another suitable propellant is a composite propellant which contains ammonium perchlorate is a rubberized binder. The composite propellant is known as HXP-100 and is purchasable from the Holex Corporation of Hollister, California. N-5 and HXP-100 propellants are disclosed in U.S. Pat. No. 4,039,030.

A M-5 solid propellant was utilized by C. F. Cuderman in an article entitled "High Energy Gas Fracturing Development", Sandia National Laboratories, SAND 83-2137, October 1983. This article is also incorporated by reference. High energy gas fracturing or controlled pulse fracturing is a method used for inducing multiple radial fractures around a wellbore or borehole. Via this method a solid propellant-based means for fracturing is employed along with a propellant composed to permit the control of pressure loading sufficient to produce multiple fractures in a borehole at the oil or hydrocarbonaceous fluid productive interval. A peak pressure is generated which is substantially above the in-situ stress pressure but below the rock yield stress pressure.

After placing the propellant means for creating multiple fractures downhole near the "fingering" fracture 16, it is ignited. Ignition of the propellant means for creating the multiple fractures causes the generation of heat and gas pressure. As is known to those skilled in the art, the amount of heat and pressure produced is dependent upon the kind of propellant used, its grain size and geometry. Heat and pressure generation also depends upon the burning rate, weight of charge and the volume of gases generated.

Subsequently, the heat and pressure are maintained for a time sufficient to allow fluid penetration and extension of fractures. As is known, heat generation and pressure maintenance are dependent upon the nature of the formation and the depth it is desired to extend the fractures into the formation. After the heat and pressure have been maintained for a time sufficient to promote the desired fracturing, the heat and pressure dissipate into the formation surrounding the wellbore. In order to more precisely direct the force and direction of the energy released, the cannister device 14 containing the propellant can be molded into a desired pattern or shape. A method and apparatus which can be used is disclosed by Keller in U.S. Pat. No. 4,018,293 which issued on Apr. 19, 1977. This patent is hereby incorporated by reference. However, as mentioned above, it is preferred to use a propellant in lieu of Keller's explosive.

Figure 2:
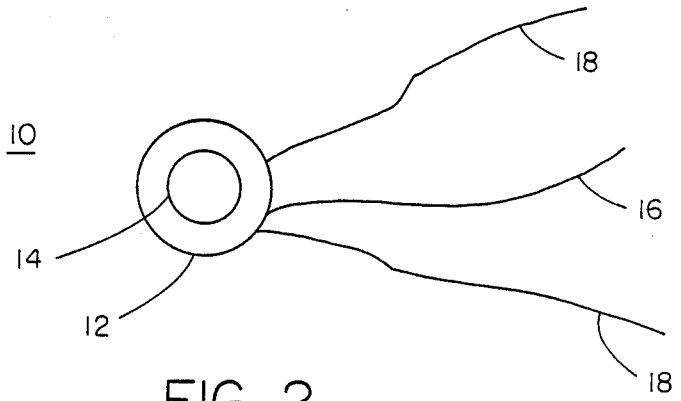
FIG. 2 is a plane view of a formation depicting multiple fractures after ignition of a propellant.

As disclosed by Godfrey et al., the propellant can be tailored to create the desired number and width of vertical fractures. By utilizing a cannister of the desired shape, the released force can be directed in a manner so as to create additional fractures sufficient to reduce the total fluid flow to the volume desired, thereby decreasing fluid bypass and obtaining a better sweep of the reservoir. The direction of the released energy should be such that existing fracture 16 would be substantially closed, or reduced to an aperture no greater than the newly created fractures 18 shown in FIG. 2.

This cubic law equation utilized herein, may have deviations when used in extremely tight fractures (aperture under 50 microns), at least in non-porous granite but this only affects the "C" constant in the equation. The same reduction of flow is seen even if the "C" constant changes. As will be understood by those skilled in the art, flow inhibitors can be used to additionally reduce flow when combined with this inventive method. These flow inhibitors include foams, surfactants, and polymers. Exemplary flow inhibitors which can be used herein include, but not limited to, LTS18, K-Trol, and Celogen AZ, which are purchasable from Shell, Halliburton, and Uniroyal, respectively.

Although it is preferred to use this method in the recovery of hydrocarbonaceous fluids from a formation containing at least one injection well, this method can also be utilized in reducing the flow of other fluids from a formation including water, gas, and steam. When one injection well is used when recovering hydrocarbonaceous fluids, that injection well can also serve as a production. As is understood by those skilled in the art, any number of injection and production wells may be utilized herein.

While it is preferred to use this method in those applications where the "fingering" fractures (16) have been produced naturally, this method can also be used in applications where fractures 16 have been induced by fracturing methods commonly utilized so long as said fractures are not propped. Several fracturing methods which can be used appear below.

U.S. Pat. No. 3,863,709 issued to Fitch on Feb. 4, 1975 discloses a method and system for recovering geothermal energy from a subterranean geothermal formation having a preferred vertical fracture orientation. At least two deviated wells are provided which extend into the geothermal formation in a direction transversely of the preferred vertical fracture orientation and a plurality of vertical fractures are hydraulically formed to intersect the deviated wells. A fluid is injected via one well into the fractures to absorb heat from the geothermal formation and the heated fluid is recovered from the formation via another well. This patent is hereby incorporated by reference herein.

Savins in U.S. Pat. No 4,067,389 issued Jan. 10, 1978, discloses a technique of hydraulically fracturing a subterranean formation wherein there is used a fracturing fluid comprised of an aqueous solution of an interaction product of a polysaccharide and a galactomannan. This patent is incorporated by reference herein.

Another fracturing technique is disclosed by Medlin et al. in U.S. Pat. No. 4,415,,035, which issued on Nov. 15, 1983. Here, a well casing penetrating a plurality of subterranean hydrocarbon-bearing formations is perforated adjacent select ones of such hydrocarbon-bearing formations that are expected to exhibit at least a minimum pressure increase during fracturing operations. A fracturing fluid is pumped down the well through the perforations, and into the formations so as to fracture each of the select formations during a single fracturing operation. This patent is incorporated by reference herein.

Where it is desired to obtain increased sweep efficiency, this invention can be used with several enhanced oil recovery methods.

One method where this invention can be utilized is during a waterflooding process for the recovery of oil from a subterranean formation. After creating the multiple smaller fractures of this invention, a waterflooding process can be commenced, U.S. Pat. No. 4,479,894, issued to Chen et al, describes one such waterflooding process. This patent is hereby incorporated by reference in its entirety.

Steamflood processes which can be utilized when employing the invention described herein are detailed in U.S. Pat. Nos. 4,489,783 and 3,918,521 issued to Shu and Snavely, respectively. These patents are hereby incorporated by reference herein.

The invention described herein can also be used in conjunction with a cyclic carbon dioxide steam stimulation in a heavy oil recovery process to obtain greater sweep efficiency. Cyclic carbon dioxide steam stimulation can be commenced after creating the smaller multiple fractures in the reservoir with this invention. Another suitable process is described in U.S. Pat. No. 4,565,249 which issued to Pebdani et al. This patent is hereby incorporated by reference in its entirety. Increased sweep efficiency can be obtained when the subject smaller multiple fractures are used in combination with a carbon dioxide process by lowering the carbon dioxide minimum miscibility pressure ("MMP") and recovering oil. Carbon dioxide MMP in an oil recovery process is described in U.S. Pat. No. 4,513,821 issued to Shu which is hereby incorporated by reference.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method for decreasing fluid bypass in a reservoir where at least one substantially large fracture exists comprising:

(a) locating at least one substantially large fracture which has caused "fingering" in said reservoir;

(b) fracturing said reservoir by applying a force sufficient to create smaller multiple fractures which have smaller apertures that produce a total lower flow rate than said large fracture;

(c) creating by said fracturing fractures with smaller apertures whereby said large fracture is substantially closed while subsequently created fractures with the smaller apertures remain open; and (d) causing thereby a decrease in total fluid flow via said created fractures which fluid flow previously emitted from said substantially large fracture thereby decreasing fluid bypass and obtaining a substantially better sweep of the reservoir.

2. The method as recited in claim 1 where said total fluid flow is decreased when producing oil, water, gas, or steam from a reservoir and mixtures thereof.

3. The method as recited in claim 1 where in step (b) said fracturing is accomplished via an explosive, hydraulic fracturing or controlled pulse fracturing.

4. The method as recited in claim 1 where total fluid flow is decreased and improved sweep efficiency obtained during a waterflood, a steamflood, or a carbon dioxide enhanced oil recovery process.

5. The method as recited in claim 1 where after step (d) flow inhibitors are used to additionally decrease the fluid bypass thereby improving sweep efficiency.

6. The method as recited in claim 1 where in step (b) controlled pulse fracturing is utilized and the force from a propellant contained in said device is caused to go in a desired direction.

7. The method as recited in claim 1 where said large fracture is either a natural or an induced fracture.

8. A method for decreasing fluid bypass in a hydrocarbonaceous fluid bearing formation or reservoir penetrated by at least one injection well where at least one substantially large fracture exists comprising:

(a) locating at least one substantially large fracture which has caused "fingering" in said reservoir;

(b) fracturing said reservoir by applying a force sufficient to create smaller multiple fractures which have smaller apertures that produce a total lower flow rate than said large fracture;

(c) creating by said fracturing fractures with smaller apertures whereby said large fracture is substantially closed while subsequently created fractures with the smaller apertures remain open; and (d) causing thereby a decrease in total fluid flow via said created fractures which fluid flow previously emitted from said substantially large fracture thereby decreasing fluid flow bypass and obtaining a substantially better sweep of hydrocarbonaceous fluids from said reservoir.

9. The method as recited in claim 8 wherein step (b) said fracturing is accomplished via an explosive, hydraulic fracturing or controlled pulse fracturing.

10. The method as recited in claim 8 where total fluid flow is decreased and improved sweep efficiency obtained during a waterflood, a steamflood, or a carbon dioxide enhanced oil recovery process.

11. The method as recited in claim 8 where after step (d) flow inhibitors are used to additionally decrease the fluid bypass thereby improving sweep efficiency.

12. The method as recited in claim 8 where in step (b) controlled pulse fracturing is utilized and the force from a propellant contained in said device is caused to go in a desired direction.

13. The method as recited in claim 8 where said large fracture is either a natural or an induced fracture.

14. A method for decreasing fluid bypass in a reservoir where at least one substantially large fracture exists comprising:

(a) locating at least one substantially large fracture which has caused "fingering" in said reservoir;

(b) fracturing said reservoir via controlled pulse fracturing where force from a propellant is caused to go in a desired direction thereby applying a force sufficient to create smaller multiple fractures which have smaller apertures that produce a total lower flow rate than said large fracture;

(c) creating by said fracturing fractures with smaller apertures whereby said large fracture is substantially closed while subsequently created fractures with the smaller apertures remain open; and (d) causing thereby a decrease in total fluid flow via said created fractures which fluid flow previously emitted from said substantially large fracture thereby decreasing fluid bypass and obtaining a substantially better sweep of the reservoir.

15. The method as recited in claim 14 where said total fluid flow is decreased when producing oil, water, gas, or stream from a reservoir and mixtures thereof.

16. The method as recited in claim 14 where total fluid flow is decreased and improved sweep efficiency obtained during a waterflood, a steamflood, or a carbon dioxide enhanced oil recovery process.

17. The method as recited in claim 14 where after step (d) flow inhibitors are used to additionally decrease the fluid bypass thereby improving sweep efficiency.

* * * * *

UNITED STATES PATENT AND TRADEMARK OFFICE

CERTIFICATE OF CORRECTION

PATENT NO. : 4,817,714

DATED : April 4, 1989

INVENTOR(S) : Timothy A. Jones

It is certified that error appears in the above-identified patent and that said Letters Patent is hereby corrected as shown below:

Column 1, line 42, "evalution" should read --evaluation--.

Column 1, line 57, "evaulation" should read --evaluation--.

Column 2, line 10, "whihc" should read --which--.

Column 3, line 57, "is" should read --in--.

Column 8, line 16, "stream" should read --steam--.

Signed and Sealed this

Twenty-sixth Day of June, 1990

*Attest:*

HARRY F. MANBECK, JR.

*Attesting Officer*

*Commissioner of Patents and Trademarks*